US006526149B1

(12) United States Patent
Khenkin et al.

(10) Patent No.: US 6,526,149 B1
(45) Date of Patent: Feb. 25, 2003

(54) SYSTEM AND METHOD FOR REDUCING NON LINEAR ELECTRICAL DISTORTION IN AN ELECTROACOUSTIC DEVICE

(75) Inventors: Aleksey S. Khenkin, Peterborough, NH (US); David E. Blackmer, Wilton, NH (US)

(73) Assignee: Earthworks, Inc., Milford, NH (US)

( * ) Notice: Subject to any disclaimer, the term of this patent is extended or adjusted under 35 U.S.C. 154(b) by 0 days.

(21) Appl. No.: 09/894,690

(22) Filed: Jun. 28, 2001

(51) Int. Cl.[7] ..... H04R 25/00
(52) U.S. Cl. ..... 381/174; 381/191
(58) Field of Search ..... 381/113, 116, 381/173, 174, 190, 191; 29/25.41, 594, 592.1; 307/400; 367/170, 181, 140

(56) References Cited

U.S. PATENT DOCUMENTS

| | | | | |
|---|---|---|---|---|
| 3,778,561 A | * | 12/1973 | Reedyk | 381/191 |
| 4,249,043 A | | 2/1981 | Morgan et al. | 179/111 E |
| 4,434,327 A | * | 2/1984 | Busch-Vishniac et al. | 381/191 |
| 4,528,426 A | | 7/1985 | Fatovic et al. | 179/121 D |
| 4,582,961 A | | 4/1986 | Frederiksen | 179/111 R |
| 4,620,446 A | | 11/1986 | Jensen et al. | 73/652 |
| 4,694,499 A | | 9/1987 | Bartlett | 381/155 |
| 4,709,391 A | | 11/1987 | Kaizer et al. | 381/98 |
| 6,243,474 B1 | * | 6/2001 | Tai et al. | 381/174 |
| 6,304,662 B1 | * | 10/2001 | Norris et al. | 381/174 |

FOREIGN PATENT DOCUMENTS

WO WO 00/35247 6/2000 ..... H04R/29/00

OTHER PUBLICATIONS

"A Self–Contained Condenser Microphone with Improved Transient Response", by Dauger et al., *Journal of the Audio Engineering Society*, presented Apr. 29, 1968 at the 34th Convention of the Audio Engineering Society, pp. 148–151.

"New High–Grade Condenser Microphone", by Bauch, *Journal of the Audio Engineering Society*, reprinted from *Wireless World*, Feb., 1953, pp. 79–80.

"Technical Documentation, Microphone Handbook", Bruel & Kjaer, Denmark, vol. 1, pp. 2–7 through 2–10.

"Reduction of Non–Linear Distortion in Condenser Microphones by Using Negative Load Capacitance", by Erling Frederiksen ,*Bruel and Kjaer Technical Review*, 1996, pp. 18–27.

"Introduction: A Short History of the Condenser Microphone", *AIP Handbook of Condenser Microphones: Theory, Calibration, and Measurements*, by Richard K. Cook, AIP Press, 1995, pp. 3–7.

"Electroacoustics, The Analyssis of Transduction, and Its Historical Background", by Frederick Hunt, *Harvard Monographs in Applied Science, No. 5*, Harvard University Press, 1995, pp. 170–173.

* cited by examiner

*Primary Examiner*—Huyen Le
(74) *Attorney, Agent, or Firm*—Grossman Tucker Perreault & Pfleger, PLLC

(57) ABSTRACT

This invention relates to a system and method for reducing non-linear electrical distortion in an electroacoustic device. Specifically, the present invention relates to a system and method for reducing spatially dependent electrical distortion, for example, distortion caused by differences in electrical displacement between a conductive membrane and a counter electrode at different parts of the conductive membrane. The system and method for reducing non-linear electrical distortion has particular application in condenser microphones comprising, for example, a conductive diaphragm receptive to sound, and a backplate electrically coupled thereto to generate an electrical output. In one exemplary embodiment, the present invention provides an electroacoustic system comprising a conductive membrane and a counter electrode electrically coupled to the conductive membrane. A face of the counter electrode facing the conductive membrane is curved. The curve is selected to reduce spatially dependant variations in electrical displacement between the counter electrode and the conductive membrane.

4 Claims, 6 Drawing Sheets

SYSTEM AND METHOD FOR REDUCING NON LINEAR ELECTRICAL DISTORTION IN AN ELECTROACOUSTIC DEVICE

BACKGROUND OF THE INVENTION

1. Field of the Invention

This invention relates to a system and method for reducing non-linear electrical distortion in an electroacoustic device. Specifically, the present invention relates to a system and method for reducing spatially dependent electrical distortion, for example, distortion caused by differences in electrical displacement between a conductive membrane and a counter electrode at different parts of the conductive membrane. The system and method for reducing non-linear electrical distortion has particular application in condenser microphones comprising, for example, a conductive diaphragm receptive to sound, and a backplate electrically coupled thereto to generate an electrical output.

2. Description of Related Art

Generally, an electroacoustic device such as, for example, a condenser microphone, converts sound pressure input into electrical output.

FIG. 1 illustrates an example of a condenser microphone system 10. The microphone 10 comprises a conductive membrane 12 exposed to sound 24, electrically coupled to a counter electrode 14. A conductive membrane 12 may be, for example, a diaphragm. Examples of counter electrodes include a back electrode, a backplate, and a conductive front grille. Generally, the counter electrode 14 is stationary and displaced in parallel and in close proximity to the conductive membrane 12, such that the combination of the electrode 14 and membrane 12 acts as a capacitor capable of storing a charge. A polarizing voltage, Eo, is applied either through a polarizing voltage source 16 and polarization resistor 18, or by using an electric layer (not shown), by which a constant initial charge is established. This constant initial charge provides initial voltage when the diaphragm 12 is not affected by sound waves 24, that is, when the diaphragm 12 is in a rest position. Additionally, the exemplary condenser microphone 10 may include one or more parasitic parallel load capacitors 20 and a preamplifier section 22 to produce an amplified electrical output 26.

When sound impinges on the membrane 12, it moves, thus changing capacitance between itself and the counter electrode. This produces a variable voltage, which is the electrical output signal, E. In an ideal electroacoustic system, the electrical output, E, varies linearly with the pressure of actuating sound waves 24 upon the membrane 12. A linear movement/output voltage relationship means that the diaphragm 12 maintains a parallel relationship with the counter electrode 14. This assumes, in the ideal case, that displacement due to a given sound pressure is in a direction perpendicular to the parallel relationship and equal in magnitude at all areas of the diaphragm 12.

FIG. 2 illustrates the parallel displacement, d, of the diaphragm 28 in relation to counter electrode 30 in an ideal system 27. Assuming, for simplicity, that no parasitic parallel load capacitances exist, $$C_a = C_0/(1+d/D), \text{ and } E = E_0\frac{C_0}{C_a} = E_0(1+d/D), \text{ where}$$

$C_a$ is the active capacitance (varies with diaphragm displacement), $C_0$ is the capacitance at rest position, d is the displacement of membrane with sound pressure, D is the rest distance between counter electrode and diaphragm, E is the output voltage (constitutes signal), and $E_0$ is the polarization voltage (voltage at rest position).

Therefore, in an ideal system, the output voltage varies linearly with the displacement between diaphragm 28 and counter electrode 30. However, in a typical electroacoustic system, the relationship between electrical output, E, and sound pressure is non linear.

FIG. 3 illustrates a typical system 31, comprising a flexible diaphragm 32, stretched and clamped at its edges. The particular tension of the diaphragm and the method of attaching are well understood in the art, and are not important for an understanding of the present invention. The displacement of the diaphragm 32 to sound at frequencies below resonance is parabolic, such that an equal distance between the diaphragm 32 and counter electrode 34 is not maintained from all areas of the diaphragm 32. For example, D/d(r1) is not equal to D/d(r2). Therefore, the change of capacitance between diaphragm 32 and counter electrode 34 is spatially dependent. This spatial dependence manifests itself as a signal dependant stray capacitance which makes active capacitance, $C_a$, nonlinear. It has been shown that the displacement of such a diaphragm may be represented by $d(r)=d_0(1-r^2/R_d^2)$, where r—radial coordinate with its origin at the center of the diaphragm, $R_d$—radius of the diaphragm $d_0$—diaphragm displacement at the center.

The initial capacitance between the diaphragm 32 and counter electrode 34, that is, the capacitance without displacement of the diaphragm 32, may be represented by, $$C_0 = \frac{\varepsilon\cdot\pi\cdot R_b^2}{D}.$$

Then, the active capacitance, $C_a$, and output voltage, E, may be represented by $$C_a = \int_0^{R_b}\frac{\varepsilon\cdot 2\pi\cdot r}{D+d_0(1-r^2/R_d^2)}dr = \frac{\varepsilon\cdot 2\pi\cdot R_b^2}{D\cdot R_b^2}\int_0^{R_b}\frac{2r}{1+\frac{d_0}{D}(1-r^2/R_d^2)}dr = C_0\cdot\frac{R_d^2}{R_b^2}\cdot\frac{D}{d_0}\cdot\ln\frac{1+d_0/D}{1+(1-R_b^2/R_d^2)\cdot d_0/D},$$

and $$E = E_0\frac{C_0}{C_a} = E_0\cdot\frac{R_b^2}{R_d^2}\cdot\frac{d_0}{D}\cdot\frac{1}{\ln\frac{1+d_0/D}{1+(1-R_b^2/R_d^2)\cdot d_0/D}},$$

where $R_b$ is the radius of the counter electrode.

As the equation for E shows, the relationship between the output voltage E and diaphragm displacement is non-linear.

FIG. 4 provides a graph 36 illustrating the non-linearity of the relationship between the output voltage and diaphragm displacement in a typical system 38 as compared to the linear relationship in an ideal system 40. The problem lies in the fact that the ratio of the motion to the distance to the counter electrode is different for different areas of the diaphragm 32.

SUMMARY OF THE INVENTION

The present invention provides a system and method for reducing variations in electrical displacement between different sections of a conductive membrane and a counter electrode electrically coupled to the conductive membrane in an electroacoustic device.

One embodiment of the present invention provides a system comprising a counter electrode, a face of which faces the conductive membrane and is curved to minimize the variations in electrical displacement between different sections of the conductive membrane and the counter electrode.

In another embodiment, the counter electrode is variably polarized to counteract for variations in displacement across the conductive membrane. In yet another embodiment, the diaphragm is variably polarized for this purpose.

In an alternative embodiment, the present invention provides a system comprising a translational apparatus for translating a rigid conductive membrane laterally to maintain its parallel relationship to the counter electrode during reverberations.

It will be appreciated by those skilled in the art that although the following Detailed Description will proceed with reference being made to exemplary embodiments and methods of use, the present invention is not intended to be limited to these exemplary embodiments and methods of use. Rather, the present invention is intended to be limited only as set forth in the accompanying claims.

DETAILED DESCRIPTION OF EXEMPLARY EMBODIMENTS

One solution provided by the present invention for reducing non-linear electrical distortion in an electroacoustic device, such as a condenser microphone, is to curve the counter electrode.

Figure 1:
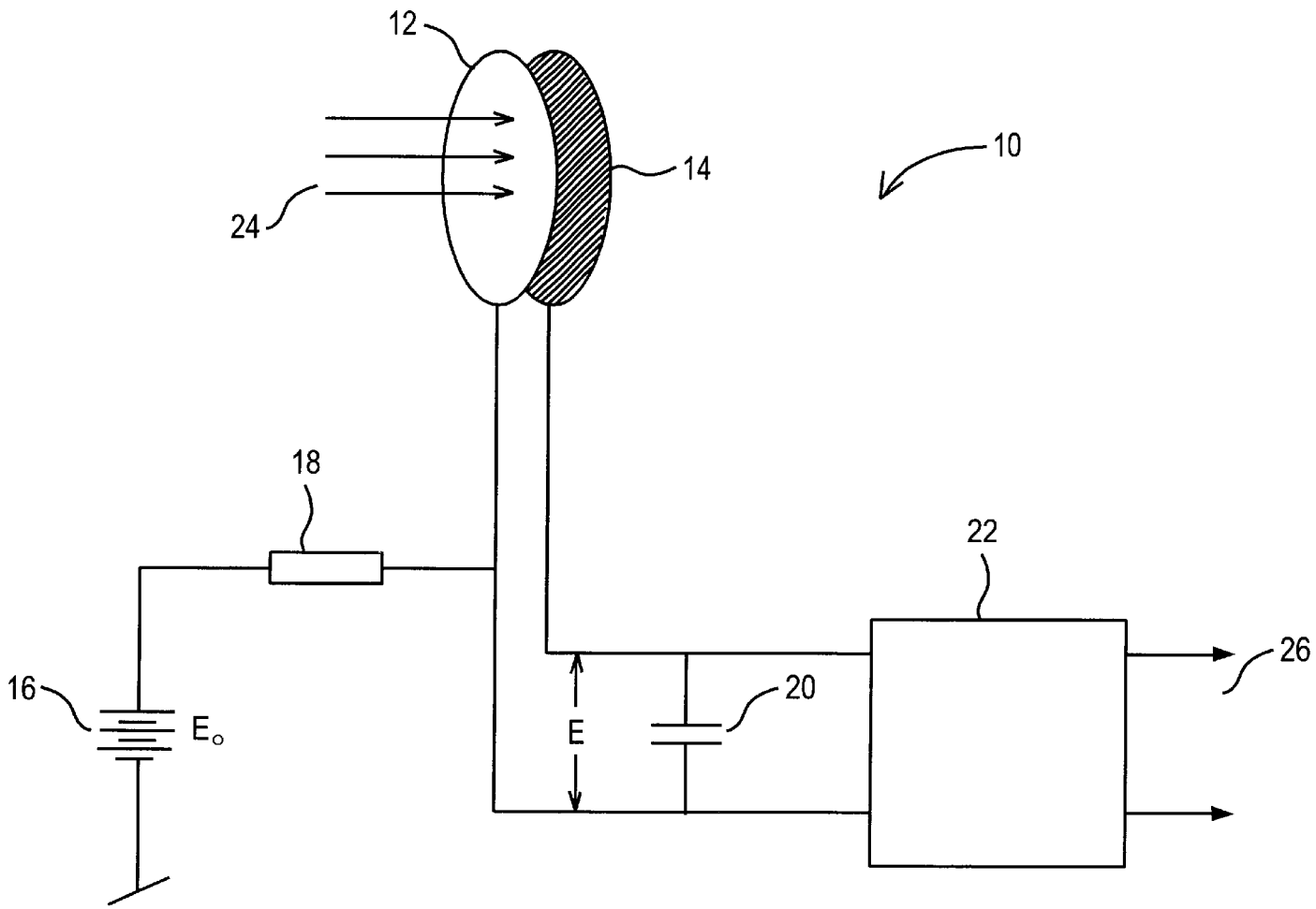
FIG. 1 is a top level circuit diagram of an exemplary condenser microphone system of the present invention.
Figure 2:
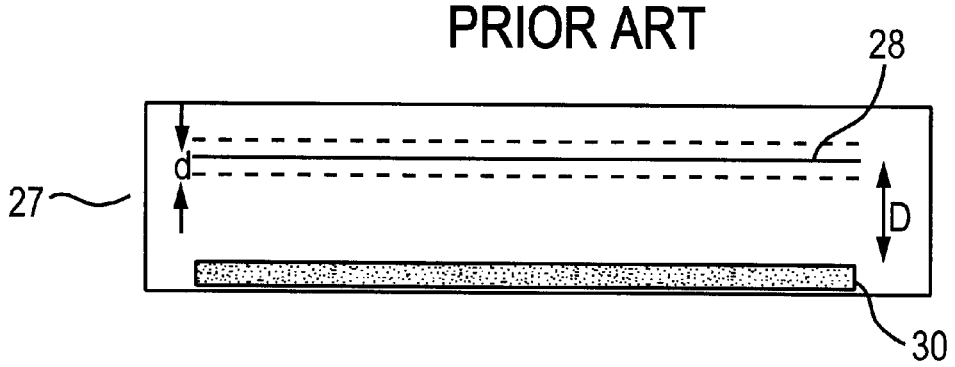
FIG. 2 PRIOR ART
FIG. 2 illustrates the parallel displacement of a diaphragm to sound with respect to a flat counter electrode in an ideal electroacoustic system.
Figure 3:
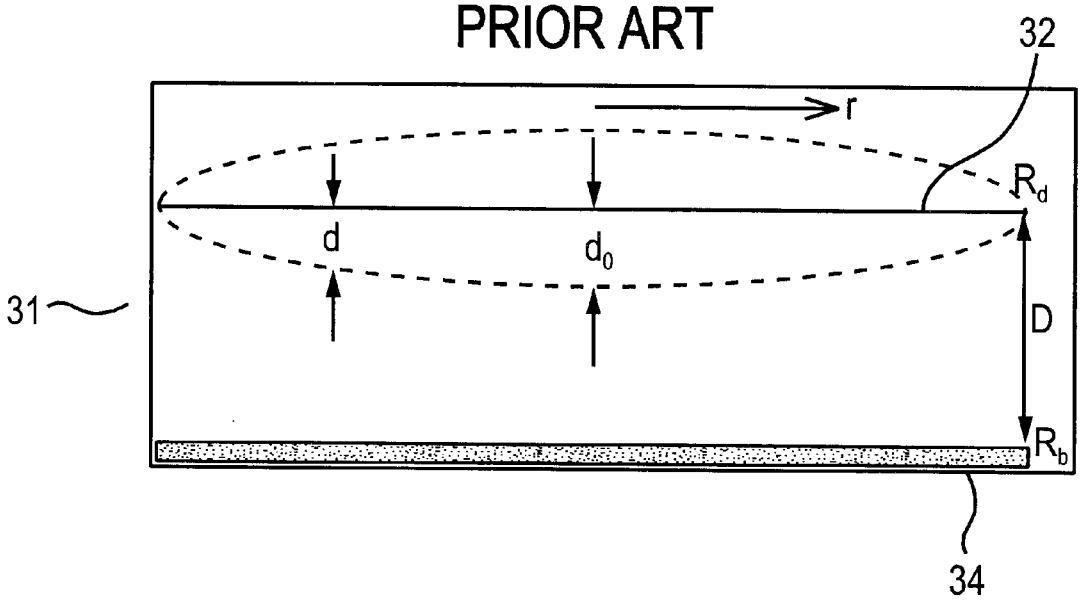
FIG. 3 PRIOR ART
FIG. 3 illustrates the parabolic displacement of a diaphragm to sound with respect to a flat counter electrode in a typical known system.
Figure 4:
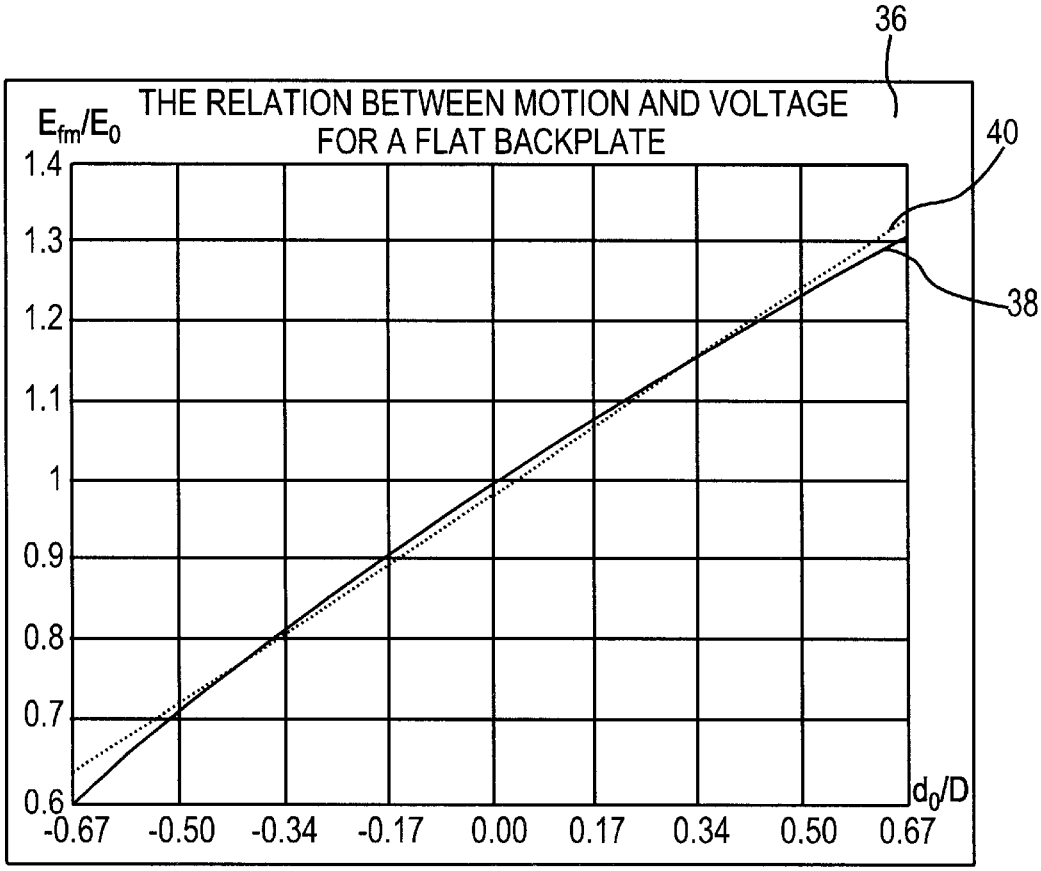
FIG. 4 PRIOR ART
FIG. 4 provides a graph of parabolic diaphragm displacement against output voltage in the typical system of FIG. 2, illustrating the non-linearity of distortion.
Figure 5:
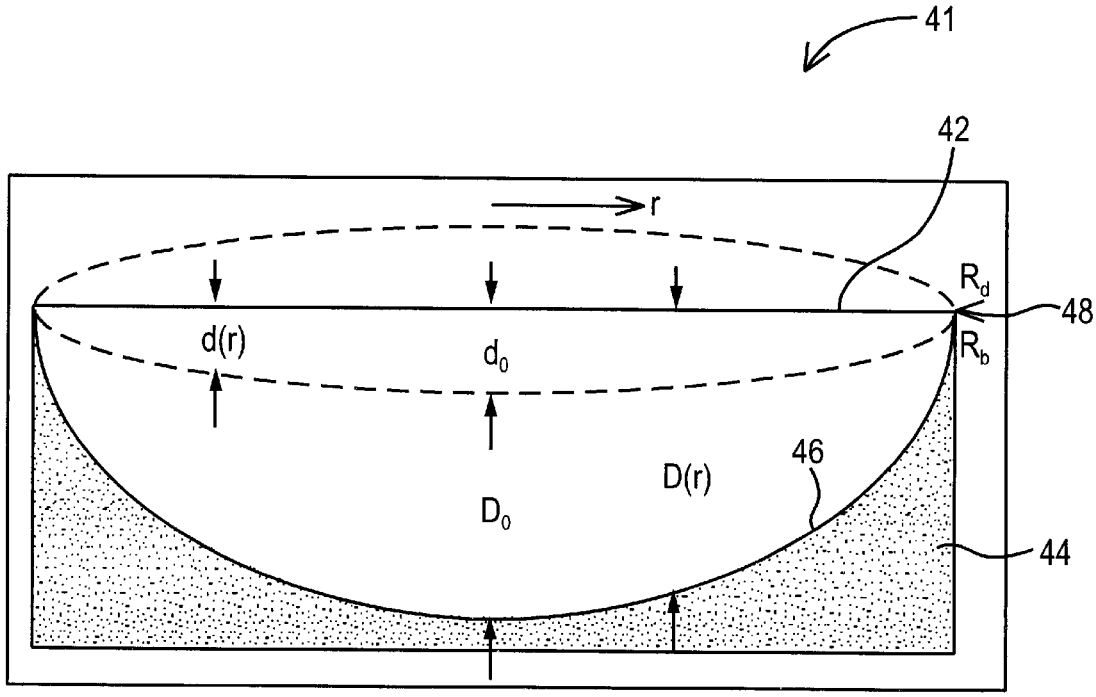
FIG. 5 illustrates a parabolic displacement of a diaphragm with respect to a curved backplate of an exemplary embodiment of the present invention.

FIG. 5 is a structural representation 41 of spatially dependent variations in sound pressure displacement of a diaphragm 42 with respect to a curved counter electrode 44 in an exemplary embodiment of the present invention. A curved counter electrode 44 is a counter electrode whose face 46 facing the diaphragm 42 is not parallel to the rest position 48 of the diaphragm 42. This embodiment provides for a parabolically curved counter electrode 44 to reduce electrical distortion caused by parabolic displacement of the diaphragm 42. Where the displacement of the diaphragm 42 is parabolic, the displacement is radially dependent. Other embodiments may provide for a counter electrode 44 that is curved in any number of ways such that the curvature of the counter electrode causes the reduction of electrical distortion caused by spatially dependent variations in displacement of the diaphragm 42 to sound.

As discussed above, in the exemplary embodiment where the diaphragm 42 reverberates parabolically, radially dependent displacement may be represented by $d(r)=d_0(1-r^2/R_d^2)$, where r is a radial variable with its origin at the center of the diaphragm 42, $R_d$ is the radius of the diaphragm 42, $d_0$ is the diaphragm displacement at the center of the diaphragm.

The profile of the parabolically curved counter electrode 44 of the exemplary embodiment with respect to the diaphragm 42 at rest may be expressed by $D(r)=D_0(1-r^2/R_d^2)$, where $D_0$ is the distance from the center of the curved face 46 of the counter electrode 44 to the center of the diaphragm 42 at rest. The initial (rest) capacitance, $C_0$, between the diaphragm 42 and counter electrode 44, for the counter electrode 44 with parabolically curved face 46, may be represented by, $$C_0 = \int_0^{R_b} \frac{\varepsilon \cdot \pi \cdot R_b^2}{D(r)} dr = \int_0^{R_b} \frac{\varepsilon \cdot \pi \cdot R_b^2}{D_0(1 - r^2/R_d^2)} dr = \frac{\varepsilon \cdot \pi \cdot R_b^2}{D_0} \int_0^{R_b} \frac{1}{1 - r^2/R_d^2} dr.$$

Using the above equations, the active capacitance, $C_a$, with radially dependent displacements of the diaphragm 42, may be represented by, $$C_a = \int_0^{R_b} \frac{\varepsilon \cdot \pi \cdot R_b^2}{D(r) + d(r)} dr = \int_0^{R_b} \frac{\varepsilon \cdot \pi \cdot R_b^2}{D_0(1 - r^2/R_d^2) + d_0(1 - r^2/R_d^2)} dr = \left(\frac{1}{1 + d_0/D_0}\right) X \left\{\frac{\varepsilon \cdot \pi \cdot R_b^2}{D_0} \int_0^{R_b} \frac{1}{1 - r^2/R_d^2} dr\right\}$$

The electrical output, E, may be derived as follows, $$E = E_0 \frac{C_0}{C_a} = E_0 \left\{ \frac{\frac{\varepsilon \cdot \pi \cdot R_b^2}{D_0} \int_0^{R_b} \frac{1}{1 - r^2 / R_d^2} dr.}{\left( \frac{1}{1 + d_0 / D_0} \right) X \left( \frac{\varepsilon \cdot \pi \cdot R_b^2}{D_0} \int_0^{R_b} \frac{1}{1 - r^2 / R_d^2} dr \right)} \right\} = E_0 (1 + d_0 / D_0)$$

The electrical output, E, has a linear relationship with the distance between the center of the diaphragm 42 and center of the counter electrode 44. Therefore, by curving the counter electrode 44, radially dependent non-linear distortions are reduced, and to at least a first order approximation, eliminated in the exemplary embodiment. In alternative embodiments, where the displacement of the diaphragm is not parabolic, but of a different spatially dependent form, the counter electrode may be shaped accordingly to reduce spatially dependent non-linear distortions.

Figure 6:
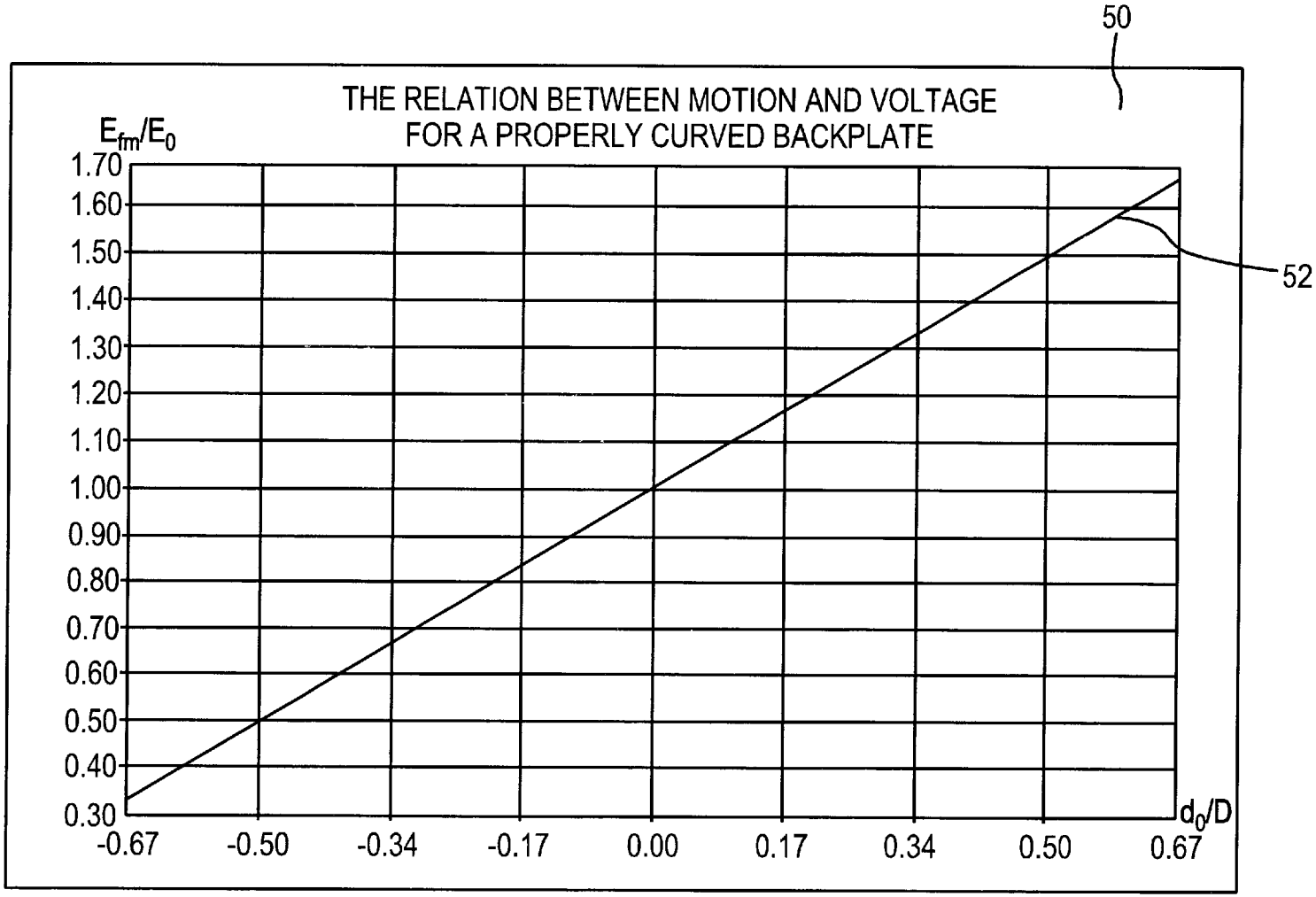
FIG. 6 provides a graph of parabolic diaphragm displacement against output voltage for a curved backplate of an exemplary embodiment of the present invention, illustrating the reduction of non-linear distortion.

FIG. 6 provides a graph 50 of distortion 52 of the electrical output by parabolic diaphragm displacement in an exemplary embodiment of the present invention where the counter electrode has a face that faces the diaphragm and is parabolically shaped. As can be seen from the graph 50, the distortion 52 is linear. In alternative embodiment, the distortion 52 may not be linear, but may, instead illustrate a reduction of non-linear distortion from that of a electroacoustic system comprising a non-curved counter electrode.

Figure 7:
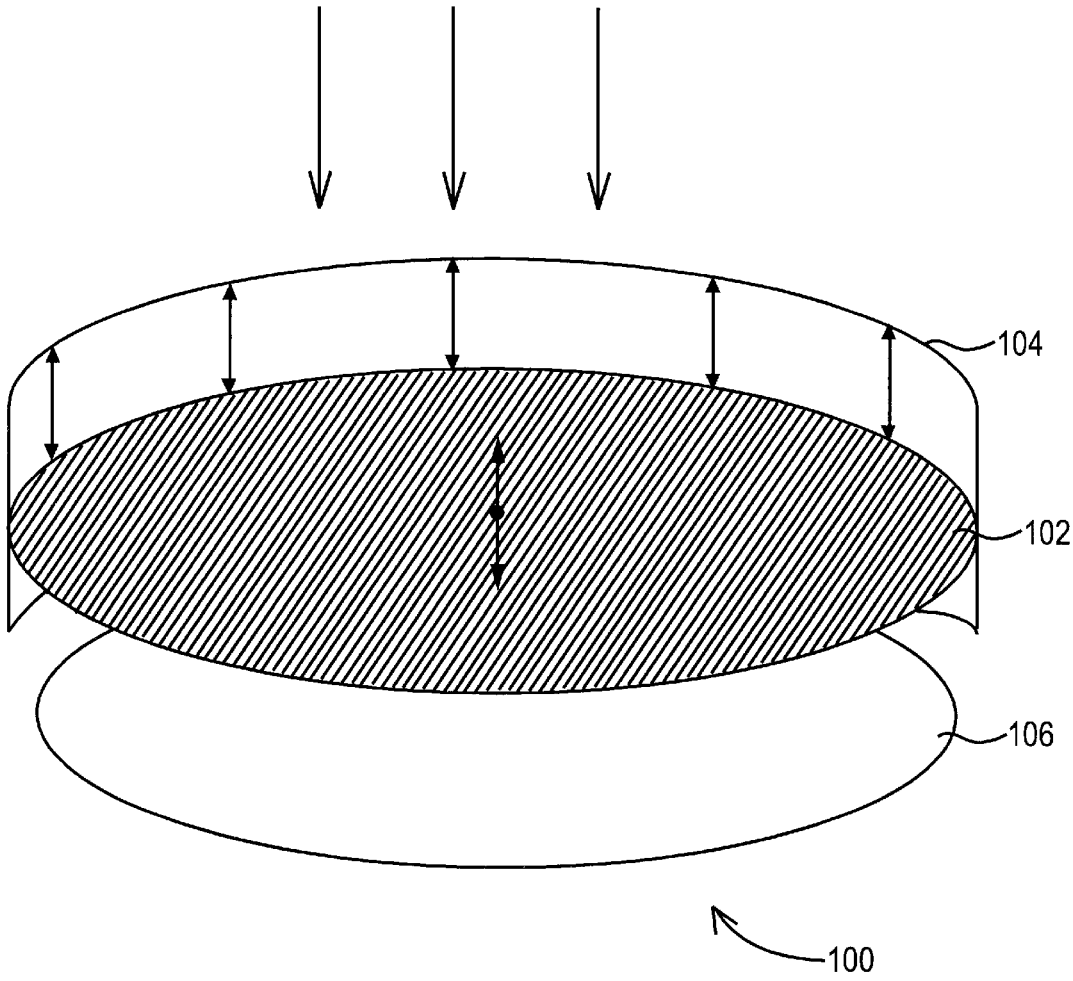
FIG. 7 illustrates an alternative system of the present invention comprising a rigid diaphragm whose edges translate laterally on a fixed groove, such that displacements of the diaphragm are lateral and not spatially, or radially, dependent, thereby preserving a parallel relationship between the diaphragm and the counter electrode.

FIG. 7 illustrates another modification 100 of the present invention comprising a rigid diaphragm 102 whose edges translate laterally on a fixed groove 104, such that displacements of the diaphragm 102 to sound are lateral and not spatially or radially dependent, thereby preserving a parallel relationship between the diaphragm 102 and the counter electrode 106. Fixed groove 104 may be constructed by utilizing a rigid conductive plate suspended on a flexible suspension at the outer edges. These and other modifications are deemed within the scope of the present invention and are only as limited by the following claims.

What is claimed is:

1. An electroacoustic system comprising a diaphragm;

a counter electrode electrically coupled to said diaphragm, wherein a face of said counter electrode, facing said diaphragm, has a curvature expressed by $D(r)=D_0(1-(r^2/R_d^2))$ where r is a radial variable with its origin at the center said diaphragm, Rd is the radius of said diaphragm, and $D_0$ is the distance from the center of said curvature to the center of said diaphragm at rest.

2. A system as claimed in claim 1, wherein said face of said counter electrode is curved to reduce spatially dependant variations in electrical displacement between said counter electrode and said diaphragm.

3. A system as claimed in claim 2, wherein said spatially dependent variations in electrical displacement are variations in electrical output caused by different magnitudes of displacement at different areas of said diaphragm in response to sound.

4. A system as claimed in claim 1, wherein said counter electrode is capacitively coupled to said diaphragm.

* * * * *